US007717052B2

(12) United States Patent
Kluge et al.

(10) Patent No.: US 7,717,052 B2
(45) Date of Patent: May 18, 2010

(54) HIGH PERFORMANCE RUDDER FOR SHIPS

(75) Inventors: Mathias Kluge, Hamburg (DE); Thomas Falz, Schwarzenbek (DE)

(73) Assignee: becker marine systems GmbH & Co., KG, Hamburg (DE)

( * ) Notice: Subject to any disclaimer, the term of this patent is extended or adjusted under 35 U.S.C. 154(b) by 0 days.

(21) Appl. No.: 12/074,251

(22) Filed: Feb. 29, 2008

(65) Prior Publication Data

US 2009/0126614 A1 May 21, 2009

(30) Foreign Application Priority Data

Nov. 16, 2007 (DE) ..... 20 2007 016 164 U
Dec. 12, 2007 (EP) ..... 07024060

(51) Int. Cl.
*B63H 25/06* (2006.01)

(52) U.S. Cl. ..... 114/165; 114/162

(58) Field of Classification Search ..... 114/162, 114/165

See application file for complete search history.

(56) References Cited

U.S. PATENT DOCUMENTS

| | | | | |
|---|---|---|---|---|
| 1,844,303 A | | 2/1932 | Wagner | |
| 3,847,104 A | | 11/1974 | Kaufer | |
| 4,024,827 A | * | 5/1977 | Becker | 114/162 |
| 4,085,694 A | | 4/1978 | Schilling et al. | |
| 5,697,315 A | | 12/1997 | Shimazaki | |
| 2007/0094881 A1 | | 5/2007 | Kluge et al. | |

FOREIGN PATENT DOCUMENTS

| | | | |
|---|---|---|---|
| DE | 2 303 299 | | 10/1974 |
| DE | 38 14 943 | | 12/1988 |
| DE | 202005019626 | | 3/2006 |
| GB | 2 206 324 | | 1/1989 |
| JP | 57191193 A | * | 11/1982 |
| JP | 5-39089 | | 2/1993 |
| JP | 8-26191 | | 1/1996 |

* cited by examiner

*Primary Examiner*—Ed Swinehart
(74) *Attorney, Agent, or Firm*—Friedrich Kueffner

(57) ABSTRACT

A high performance full spade rudder for ships includes a rudder blade, a rudder trunk and a rudder post. The rudder blade widens from the leading edge to a central area which constitutes the widest point of the rudder profile. The rudder blade profile tapers from the central area to a narrow rear area and widens again from the rear area to the trailing edge. A bearing is placed in an inner longitudinal bore of the rudder trunk for bearing the rudder post, wherein the bearing penetrates with its free end into a recess, taper or the like in the rudder blade. No bearing is provided between the rudder blade and the rudder trunk. The bearing for the rudder post is placed in the rudder trunk in the area of the free end of the rudder trunk.

23 Claims, 6 Drawing Sheets

HIGH PERFORMANCE RUDDER FOR SHIPS

BACKGROUND OF THE INVENTION

1. Field of the Invention

The present invention relates to a high performance rudder for ships which is configured as a fully balanced or respectively a full spade rudder and has a rudder blade, a rudder trunk and a rudder post, wherein the rudder blade comprises a leading edge and a trailing edge.

2. Description of the Related Art

Such rudders are known from the prior art. When mounted in a ship, the rudder is normally placed behind a propeller provided on the hull of the ship with respect to the direction of motion of the ship, wherein the leading edge of the rudder blade is turned to the propeller and the trailing edge is turned away from the propeller. When mounted, the leading edge and the trailing edge are normally oriented substantially vertically.

High performance rudders, also known as high lift rudders, are rudders which generate a high dynamic lift and thus have a particularly good rudder effect. In particular, rudders which have a $K_2$-factor of 1.4 or higher are considered to be high performance rudders. The rate of this $K_2$-factor depends particularly on the form of the profile. The $K_2$-factor is a factor which is used for determining the rudder power according to the following formula:

$$C_R=132\cdot A\cdot v^2\cdot K_1\cdot K_2\cdot K_3\cdot K_t[N]$$

v=speed $K_1$=factor depending on the side ratio of the rudder surface $K_2$=factor depending on the type of the rudder profile $K_3$=factor depending on the rudder arrangement $K_4$=factor depending on thrust loading factor For the purposes of this invention, the term "rigid rudder" is to be understood to denote a rudder blade which consists of a single rigid body and which has no actuatable or movable parts such as for example an actuatable fin or the like.

SUMMARY OF THE INVENTION

The object of this invention is to provide a high performance rudder of the type mentioned above for which good maneuverability properties can be achieved with a rigid rudder blade without movable parts, and which can simultaneously be subject to high stresses, in particular to bending moments, and which can thus also be used for very big ships.

This object is achieved with a high performance rudder of the type mentioned above which in the introduction has in a cross-sectional view a rudder blade profile which widens from the preferably rounded-off configured leading edge in rudder longitudinal direction to a central area, which constitutes the widest point of the rudder profile, with a first flank angle, which tapers from the central area to a rear area, which constitutes the narrowest point of the rudder profile, with a second flank angle, and which widens again in particular as a fishtail from the rear area to the preferably straight-lined configured trailing edge. Moreover, the rudder trunk of the rudder is provided as a cantilever with a central inner longitudinal bore for receiving the rudder post and is configured penetrating into the rudder blade, wherein a bearing is placed in the inner longitudinal bore of the rudder trunk for bearing the rudder post, the bearing penetrating with its free end into a recess, taper or the like in the rudder post, wherein the rudder post is guided with an end area out of the rudder trunk and is connected with this end area with the rudder blade, wherein no bearing is provided between the rudder blade and the rudder trunk and wherein the inner bearing for bearing the rudder post is placed in the rudder trunk in the area of the free end of the rudder trunk. Correspondingly, the invention consists of the cooperation of a particularly configured rudder profile with a special rudder bearing arrangement. Due to the specially configured rudder profile, the flow and maneuverability properties of the high performance rudder are greatly improved. First, the preferably rounded-off configured front leading edge guarantees that there are good flow properties for the leading edge for all rudder positions or angles. Due to the fishtail-type extension from the rear area to the preferably straight-lined configured rear trailing edge and due to the widening of this area respectively, the flow is accelerated even more in this area and the lift is increased even more in the rear area of the rudder. On the whole, due to the special configuration of the profile, the directional stability, due to a reduction of crabbing, as well as the ship control properties are considerably improved. With the rudder according to the invention, rudder angles up to respectively 70° to the starboard and to the port side are possible. Besides a straight-lined configuration, the trailing edge can also be configured convex or even multiple convex, for example bi-convex.

Due to the special bearing arrangement for this rudder profile, there results the advantage that the rudder trunk penetrates into the rudder blade and the rudder post is positioned in the end area of the rudder trunk in a taper or the like of the rudder blade by means of a bearing. No further bearing of the rudder blade is necessary on the outer wall surface of the rudder trunk. Thus, the lower main bearing, also called neck bearing, can be positioned in the vicinity of the lift centre of the rudder and not, as is the case for conventional bearing arrangements, above the rudder blade. The stresses and bending moments which act onto the rudder blade are thus considerably reduced. In particular, contrary to conventional rudders, no bending moments or only slight ones act onto the rudder post since it is supported in its lower area introduced in the rudder blade in the rudder trunk. Due to this, the circumference of the rudder post as well as the width of the rudder blade itself can have smaller dimensions than conventional high performance rudders. Consequently, rudder constructions of the high performance rudder according to the invention are also possible for very big ships, i.e. with very big dimensions. Moreover, the production costs are thus reduced compared to conventional rudders since less material is used. The reduction of the rudder width is particularly advantageous for rudders with the profile according to the invention since they have, due to their profile shape, increased lift forces which act onto the rudder blade so that the rudder blade must be dimensioned anyway thicker or wider than this is the case for rudders with other profiles and they have thus a relatively high drag which is reduced due to the reduction of the rudder width. Therefore, a use of such profiled rudders would not be possible for big ships without the bearing arrangement according to the invention.

According to a preferred embodiment of the invention, the rudder according to the invention is provided in a ship which comprises a propeller assigned to the rudder and placed on a drivable propeller spindle. Furthermore, the connection of the rudder post with the rudder blade is disposed above the propeller spindle middle. This being, it is advantageous that, for replacing the propeller spindle, the rudder post does not need to be removed out of the rudder trunk after having taken off the rudder blade, since the connection of the rudder post with the rudder blade is situated above the propeller spindle middle and the rudder post is connected in its end area with the rudder post, in particular by means of a press-fit.

Furthermore, it can be appropriate to configure the rudder profile symmetrical so that there are the same lift conditions on the starboard side as well as on the port side. Such an embodiment is advantageous for the course keeping characteristics of a ship.

In a further preferred embodiment, the trailing edge which is, when mounted, normally turned away from the ship propeller, has two superimposed trailing edge sections which are placed laterally offset to each other. The indication that the trailing edge sections are placed superimposed refers to the mounted state of the rudder blade in which usually a section is placed above the other. Generally speaking, both trailing edge sections are thus placed adjacent to each other. Preferably, they are separated by a separation line or plane which extends substantially horizontally, when the rudder is mounted. Due to the offset arrangement, the one trailing edge section is offset to the port or starboard side and the other trailing edge section to the starboard or port side. Thus, an offset surface is respectively created on each trailing edge section in the area in which both trailing edge sections are adjacent to each other, this offset surface normally protruding or projecting laterally respectively over the other trailing edge section. The configuration of this embodiment results in a (90°) edge on each side in the transition area between the two trailing edge sections which runs into one of the offset surfaces. A further (90°) edge is created on the inner side of the offset surfaces.

In a further embodiment, a transition area which constitutes a continuous transition between the two offset trailing edge sections can be provided between the two trailing edge sections so that no offset surface or edge or the like is produced. Due to the offset or twisted arrangement of the trailing edge sections, the sections adapt themselves to the spin produced by the propeller so that an energy recuperation can be achieved which results in a reduction of the fuel consumption with a constant power output.

Particularly preferably for this embodiment the trailing edge sections are configured in a cross-sectional view with the shape of a half, longitudinally divided fishtail. This being, the tip of the fishtail of the one trailing edge section projects to the port side and of the other trailing edge section to the starboard side. In other words, both fishtail sections are disposed mirror-inverted in a top view onto the rudder profile. A particularly high energy recuperation can be achieved by such a configuration.

Tests of the applicant showed that it is particularly advantageous if the first flank angle is from 5° to 25°, preferably from 10° to 20°, particularly preferably from 12° to 16°. This configuration results in a particularly streamlined profile of the rudder blade which positively influences the lift of the rudder. In conventional rudders, the first flank angles are considerably greater than those of this very invention since the rudder blade body must be wider in order to be able to absorb the occurring loads, in particular for big ships. Due to the configuration of the high performance rudder according to the invention, such a wide embodiment is not necessary and smaller flank angles which result in a thinner rudder blade can be used.

According to a further preferred embodiment, the second flank angle is from 5° to 17°, preferably from 8° to 13°, particularly preferably 11°. In a similar manner as for the first flank angle, the second flank angle for this very invention can also be flatter or smaller than for conventional comparable rudders known from the prior art.

Preferably, the width ratio of the width of the trailing edge to the width of the central area is from 0.3 to 0.5, preferably from 0.35 to 0.45, particularly preferably from 0.38 to 0.43. The central area characterizes the widest or the thickest area of the rudder profile. Due to the rudder bearing arrangement according to the invention, it is possible to achieve such width ratios between the widest spot and the width of the rear trailing edge. For rudders known from the prior art, the width ratios are considerably smaller, i.e. the central and widest area of the rudder profile is, for prior art rudders, considerably bigger compared to the width of the rear trailing edge. This is due to the fact that for prior art rudders the rudder post must be configured extremely wide and the rudder blade must be reinforced in order to be able to absorb the loads acting thereon, in particular for big rudders for big ships since the rudder trunk does not penetrate into the rudder blade and thus substantially bigger loads act onto the rudder post. This is why, for rudders known from the prior art, maximal width ratios of 0.25 are possible (see for example DE 2 303 299 A1), which increases the material required and thus the manufacturing costs. Moreover, the drag of these rudders is higher.

Moreover, the length ratio of the distance from the rudder post middle to the front leading edge with respect to the overall length of the rudder is from 0.25 to 0.45, preferably from 0.35 to 0.43, particularly preferably from 0.38 to 0.42. Such an arrangement of the rudder post with respect to the overall length of the rudder improves globally the flow profile of the rudder. In particular a ratio of 0.4 results in a particularly optimal flow balancing of the rudder. Moreover, the rudder post is placed preferably in the central area of the rudder, i.e. at its widest or thickest spot. Thus, the pivotal point of the rudder is situated in the central area, i.e. in the area of the biggest profile thickness. Such an arrangement is only possible due to the special slim profile configuration in connection with the special rudder bearing arrangement according to the invention. Due to the arrangement of the rudder post in the area of the biggest profile thickness, it is possible to guide the rudder trunk and the rudder post into the rudder blade.

According to a further preferred embodiment of the invention, the ratio of the propeller diameter to the height of the rudder blade is from 0.8 to 0.95, preferably from 0.82 to 0.9, particularly preferably from 0.85 to 0.87. Thus, it is guaranteed that the propeller jet can flow against the whole profile of the rudder blade and that thus a maximal lift is achieved. Due to the configuration according to the invention, it is possible to provide comparatively high rudder blades since the bearing takes place inside the rudder blade and the bending moment loads are thus much lower compared to rudder blades that are supported further above. Insofar the height of the rudder blade can be bigger than for rudders known from the prior art.

Preferably, the rudder profile has a substantially straight-lined or a substantially convex curved course between the central area (the widest spot of the rudder profile) and the rear are (the narrowest spot of the rudder profile). In this way an optimal conformation can be achieved with respect to the flow properties of the rudder.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DETAILED DESCRIPTION OF THE INVENTION

Figure 1:
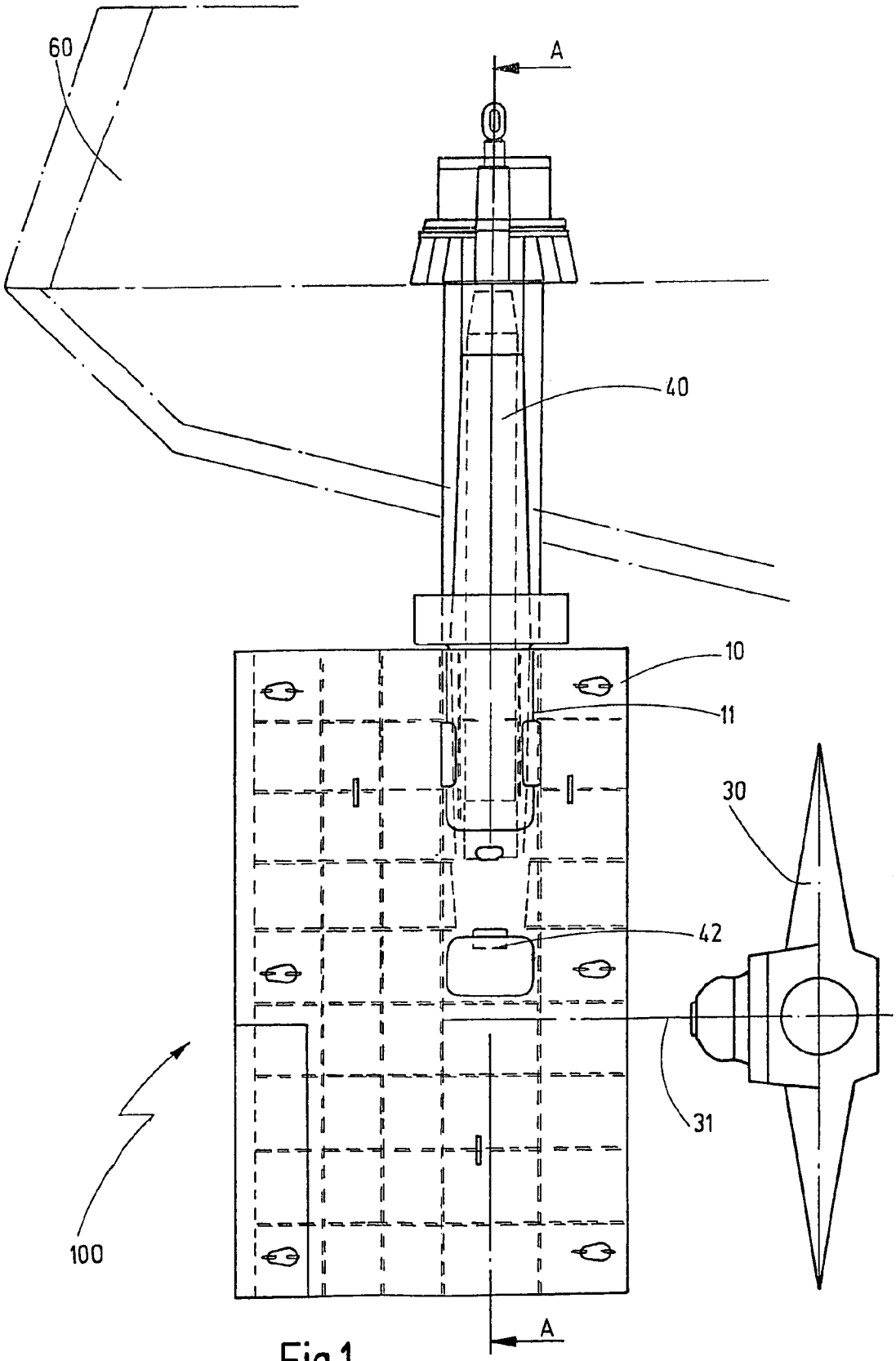
FIG. 1 is a schematic lateral view of a high performance rudder with a rudder blade supported on the hull of a ship and a propeller assigned to the rudder.
Figures 2A, 2B:
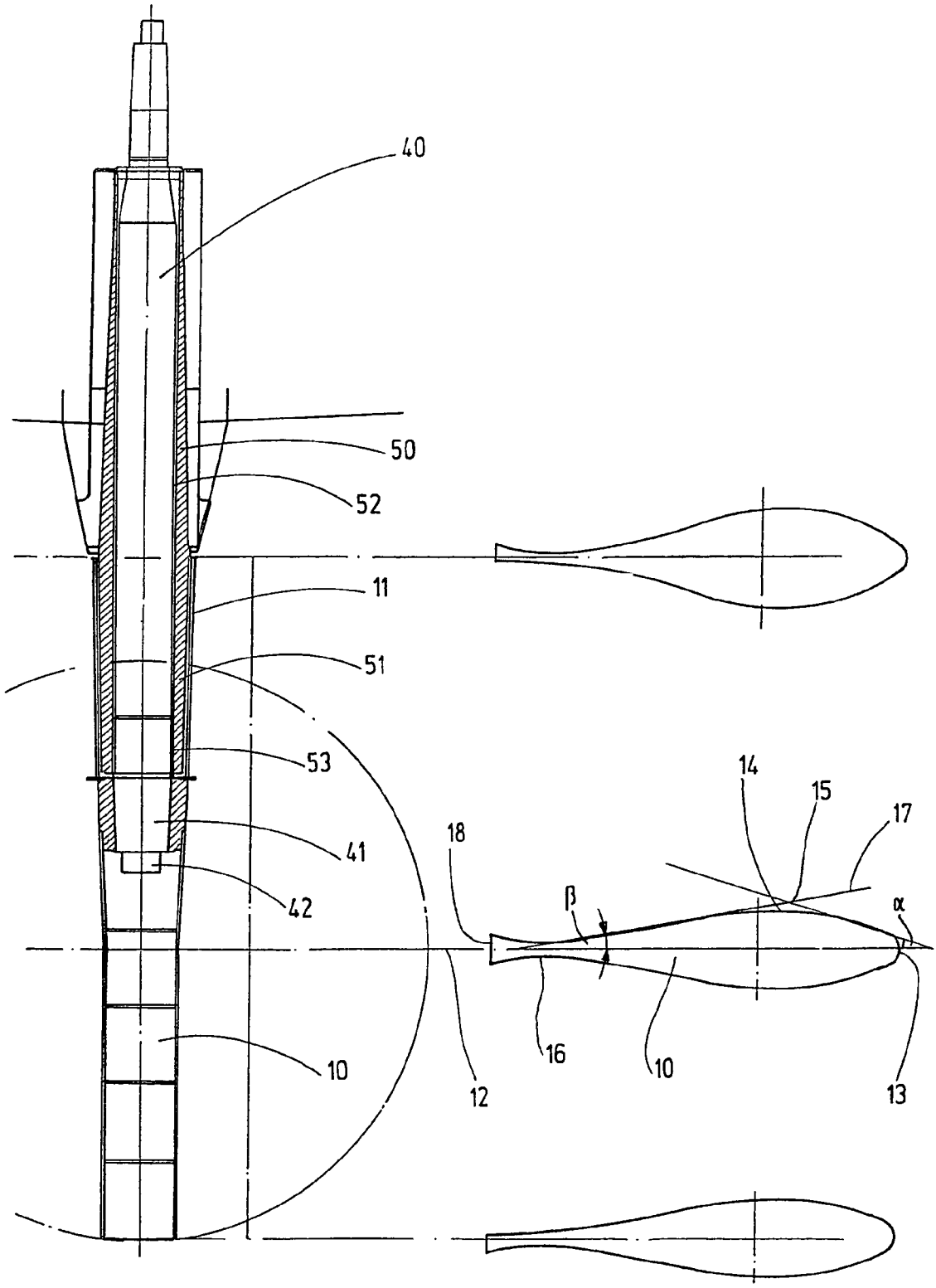
FIG. 2*a* is a schematic vertical section according to the intersection line A-A- of FIG. 1.
FIG. 2*b* shows schematic cross-sectional views of the rudder profile along the respective intersection lines through the illustration of FIG. 2*a*.

In FIGS. 1 and 2*a*, a rudder arrangement which comprises a rudder 100 with a rudder blade 10 and a propeller 30 is illustrated. The propeller 30 is connected with the hull of a ship (which is not depicted here). 40 designates a rudder post and 50 a rudder trunk surrounding the rudder post 40. The propeller 30 is assigned to the rudder blade 10. The rudder blade 10 is connected with the hull 60 of a ship by means of the rudder post 40. The rudder blade 10 has a front leading edge 13 turned to the propeller 30 and a rear trailing edge 18 turned away from the propeller 30.

The rudder blade 10 has a preferably cylindrical taper 11. The taper 11 is formed to receive the free end 51 of the rudder trunk 50.

The rudder trunk 50 is provided as a cantilever girder with a central inner longitudinal bore 52 for receiving the rudder post 40 for the rudder blade 10 so that it has approximately the shape of a tube. Moreover, the rudder trunk 50 is configured penetrating into the rudder blade 10. In its inner longitudinal bore 52, the rudder trunk 50 has a bearing 53 for bearing the rudder post 40, wherein this bearing 53 is placed in the lower end area 51 of the rudder trunk 50. The rudder post 40 is guided out of the rudder trunk 50 or out of the bearing 53 with its free end 41. This free end 41 of the rudder post 40 which is projecting from the rudder trunk 50 is fixedly connected with the rudder blade 10 by means of a press-fit, wherein, however, a connection is provided here which makes possible a release of the rudder blade 10 from the rudder post 40, when the propeller spindle has to be replaced. This being, the connection of the rudder post 40 with the rudder blade 10 in the area 41 is situated above the propeller spindle middle 31 (see FIG. 1) so that for the removal of the propeller spindle only the rudder blade 10 has to be removed from the rudder post 40 while on the other hand an extraction of the rudder post 40 out of the rudder trunk 50 is not necessary since the free lower end 51 of the rudder trunk 50 as well as the free lower end 41 of the rudder post 40 are situated above the propeller spindle middle 31. A lock nut 42 is provided for locking the assembly between the free end 41 of the rudder post 40 and the rudder blade 10. The area of the rudder blade 10 which surrounds the free end 41 is configured as a forged piece made of wrought iron and is also designated as a "hub".

For this embodiment shown in FIGS. 1 and 2*a*, only a single inner bearing 53 is provided for the bearing of the rudder post 40 in the rudder trunk 50; there is no further bearing for the rudder blade 10 on the outer wall of the rudder trunk 50.

FIG. 2*b* shows the profile of the rudder blade 10 along an intersection line 12. It can clearly be recognized that the rudder blade 10 in the profile view has a rounded off front leading edge 13. From the leading edge 13, the profile of the rudder blade 10 widens with a first flank angle $\alpha$ to a central area 14 which constitutes the widest point of the profile or of the rudder blade 10. The first flank angle $\alpha$ is constituted by a tangent 15 on the widening area between the front leading edge 13 and the central area 14 and the intersection line 12, wherein the latter simultaneously constitutes the longitudinal axis of the profile of the rudder blade 10. From the central area 13, the profile of the rudder blade 10 tapers again to a rear area 16 which constitutes the narrowest point of the rudder profile. The taper takes places with a second flank angle $\beta$ which is formed by a tangent 17 and the intersection plane 12. From the rear area 16, the profile widens again to its end which is formed by a rear trailing edge 18 which is configured straight-lined. In this very case, this widening is configured on both sides in a central area with respect to the rudder blade height so that the rudder profile widens like a fishtail. In the upper and lower area of the rudder blade, the widening is configured on one side which results in half a fishtail. The one widening is provided on the port side and the other widening on the starboard side. Basically the widening can also be configured like a fishtail or one-sided like half a fishtail over the whole rudder blade height.

Figure 4A:
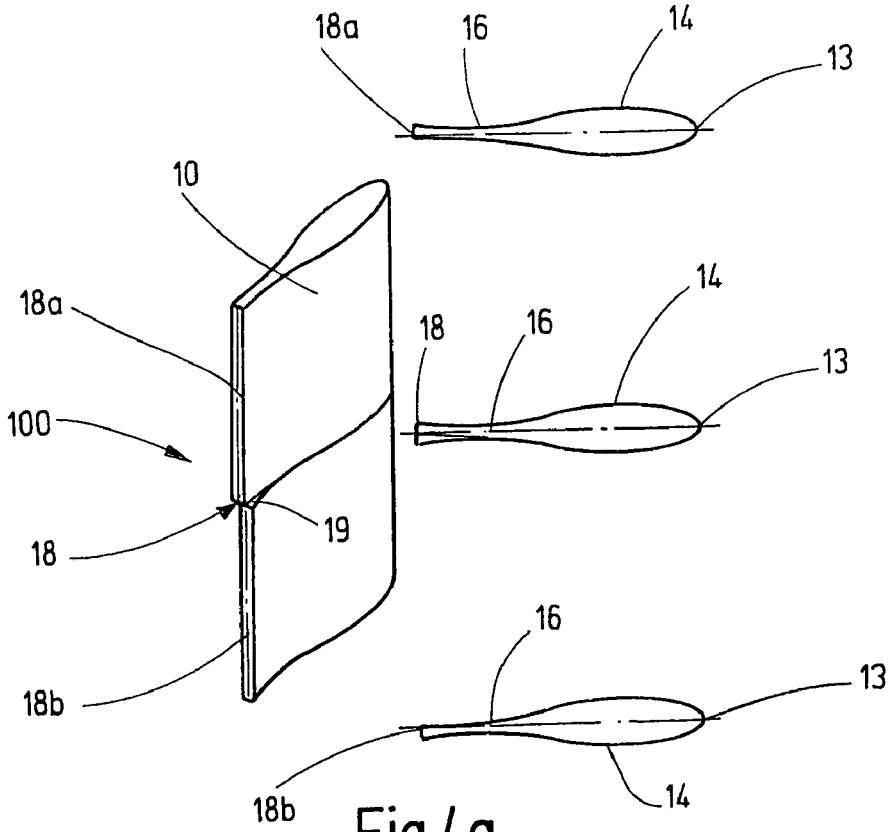
FIG. 4*a* is a schematic perspective view of a rudder profile with cross-sectional views of the profile.

FIG. 4*a* shows a perspective view of a rudder profile which corresponds to the profile of the rudder of FIGS. 2*a* and 2*b*. Accordingly, the cross-sectional views of FIG. 4*a* coincide with the cross-sectional view of FIG. 2*b*. As can be recognized from FIG. 4*a*, the rudder blade 10 is configured twisted in its rear area, i.e. the trailing edge 18 is divided into two trailing edge sections 18*a*, 18*b* which are placed superimposed. Both trailing edge sections 18*a*, 18*b* have approximately the same length and are divided by a horizontally extending separating line or separating plane placed in the middle of the rudder blade 10. They are placed offset to each other, wherein the upper trailing edge section 18*a* is offset to the port side, this being considered in the direction of motion of the ship, and the lower trailing edge section 18*b* to the starboard side. This results in a port-sided widening 18*a* with the shape of a half fishtail in the end area of the rudder blade in the upper cross-sectional view and a mirror-inverted starboard-sided widening 18*b* in the lower cross-sectional view. In the central cross-sectional view, both half fishtail-shaped trailing edge sections 18*a*, 18*b* are represented superimposed and thus constitute, put together, a full fishtail. Due to the offset arrangement of the trailing edge sections 18*a*, 18*b* to each other, an offset surface 19 in the area in which both trailing edge sections 18*a*, 18*b* are adjacent to each other is formed on each side of the rudder blade. The offset surface 19 is formed by the area of the upper edge area of the trailing edge section 18*b* or of the lower edge area of the trailing edge section 18*a* which protrudes laterally.

Figure 4B:
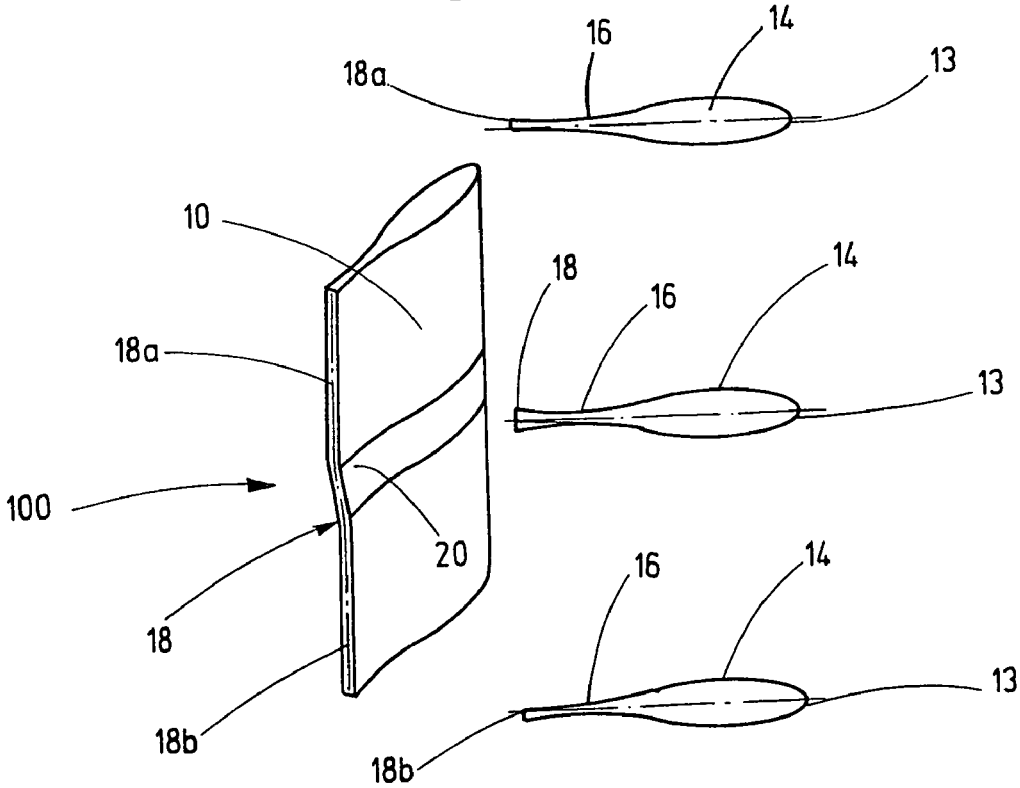
FIG. 4*b* is a schematic perspective view of a further rudder profile with cross-sectional views of the profile.

FIG. 4*b* shows a similar embodiment of a rudder profile with two trailing edge sections 18*a*, 18*b* which are also placed offset to each other, wherein a transition area 20 is provided between these two trailing edge sections 18*a*, 18*b*. This transition area 20 extends obliquely with respect to a vertical axis and connects both trailing edge sections 18*a*, 18*b* with each other so that a continuous transition without edges or offset surfaces or the like is created. Thus, also a closed flow profile is formed in the area of the trailing edge 18. The cross-sectional views of the rudder profile of FIG. 4*b* are similar to those of FIG. 4*a* or FIG. 2*b*.

Figure 4C:
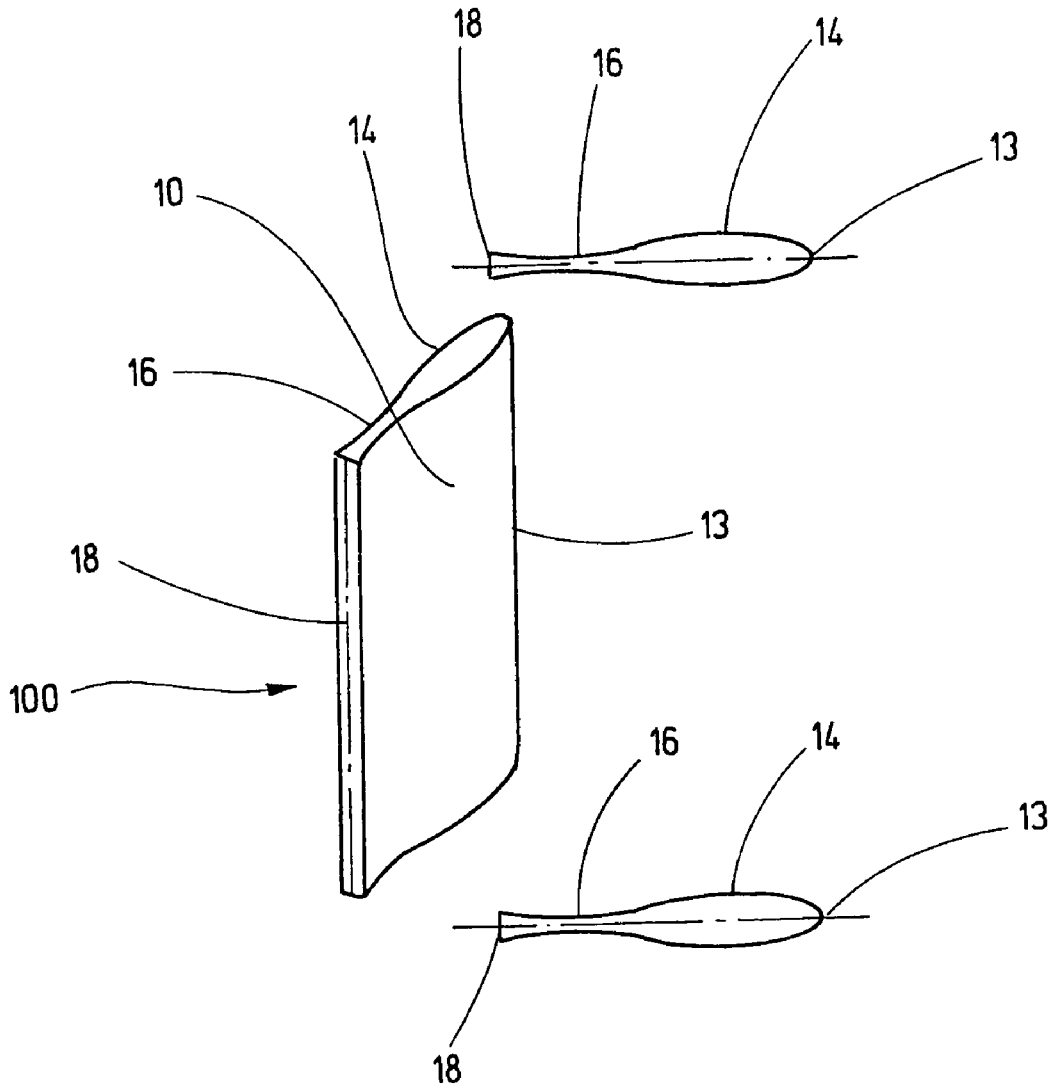
FIG. 4*c* is a schematic perspective view of still another rudder profile with cross-sectional views of this profile.

FIG. 4*c* shows a further perspective view of a further rudder profile. For this rudder profile, the trailing edge 18 is configured continuous, i.e. it does not have any sections which are offset to each other. Accordingly, a fishtail-like widening from the rear area 16 to the trailing edge 18 in the upper area as well as in the lower area is recognizable from the cross-sectional views of this profile. Basically the course of the profiles from FIG. 4*a* to 4*c* is similar to the course from FIG. 2*b* with respect to the widening of the profile with a first flank angle α and the taper of the profile with a second flank angle β.

Figure 3B:
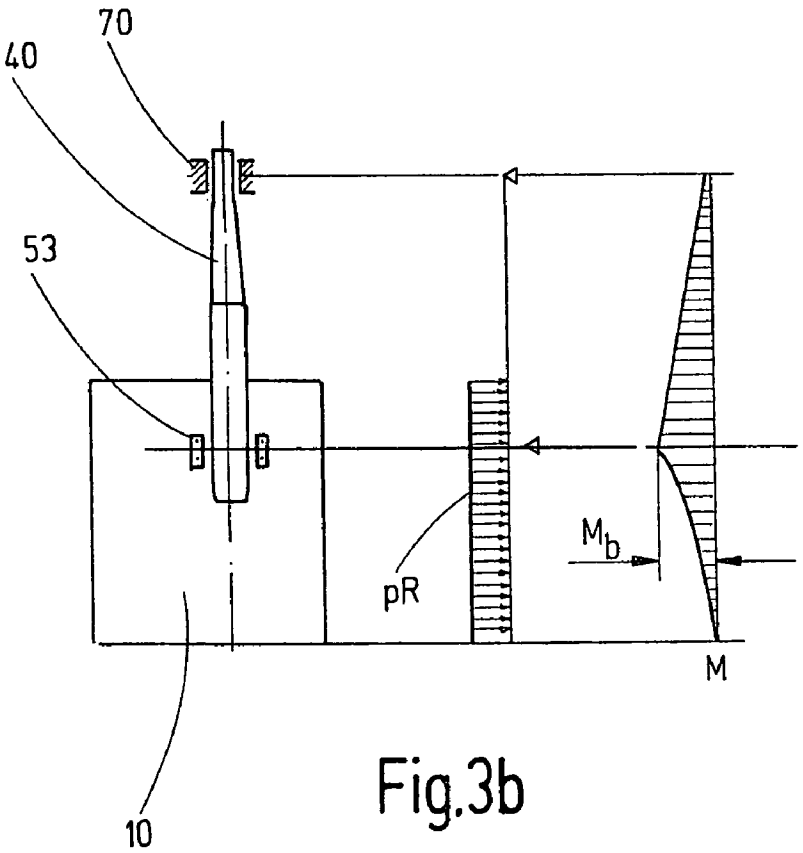
FIG. 3*b* is a schematic lateral view of a high performance rudder according to the invention as a full spade rudder with a corresponding moment curve.
Figure 3A:
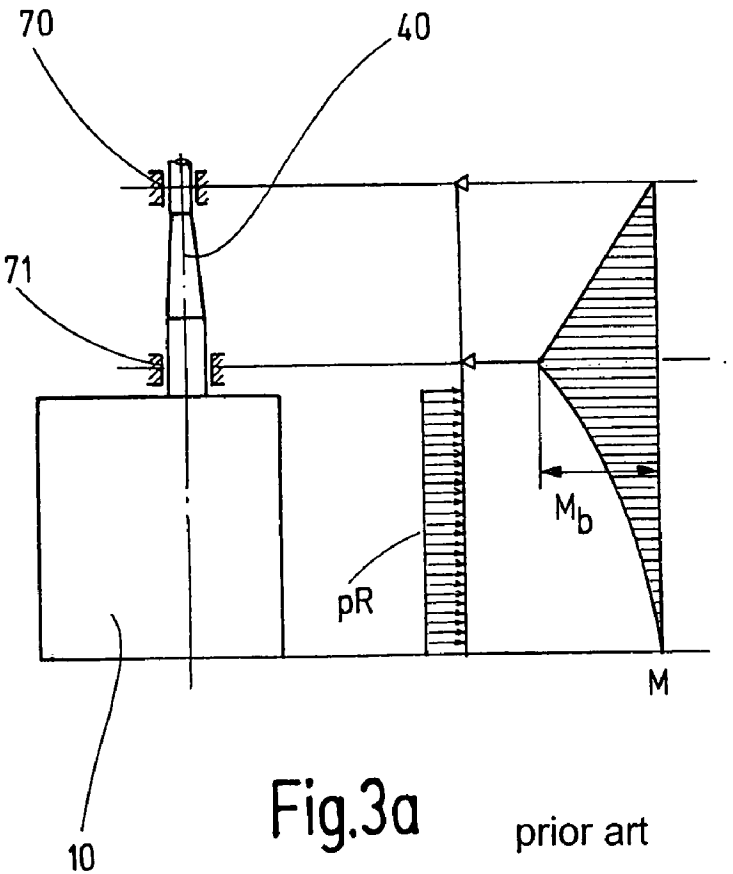
Fig.3a prior art
FIG. 3*a* is a schematic lateral view of a schematically depicted high performance rudder as a full spade rudder from the prior art with a corresponding moment curve.

FIG. 3*a* shows schematically a rudder blade 10 of a full spade or also called fully balanced rudder from the prior art. This rudder blade 10 is connected with a rudder post 40 with the hull of a ship (which is not illustrated here), wherein the rudder post 40 is fixedly connected in the upper area of the rudder blade 10 with the rudder blade. The rudder post 40 is positioned with a first upper bearing 70 and a second lower bearing 71, wherein the second lower bearing is placed directly above the rudder blade 10.

A full spade rudder with a rudder blade 10 according to this very invention is schematically illustrated in FIG. 3*b*, the rudder post 40 of which is positioned in its upper area with an upper bearing 70 and with a bearing 53 which is placed in the lower area of the rudder post in the rudder blade 10. The rudder post 40 penetrates here into the rudder which is not the case with the prior art of FIG. 3*a*. The rudder trunk is not depicted here for reasons of clarity. Thus, the lower bearing 53 of the rudder in FIG. 3*b* for the embodiment according to the invention is placed closer to the lift centre of the rudder blade 10 than this is the case for the rudder of the prior art according to FIG. 3*a*. Accordingly, for the rudder of FIG. 3*b*, there results another moment curve with respect to that of FIG. 3*a*, wherein the calculation is based in both cases on an equally big constant uniform load as the stress acting on the rudder blade 10. For FIG. 3*a*, the maximal moment $M_b$ occurs in the area of the upper bearing 71 while for the rudder according to FIG. 3*b* it occurs in the area of the lower bearing 53 which is disposed inside the rudder blade 10. The maximum moment $M_b$ for FIG. 3*b* is also much lower than for FIG. 3*a* (approximately 50% less). This is due to the fact that the leverage with which the load $p_R$ acts onto the rudder blade 10 for the arrangement of FIG. 3*b* is much lower than for the arrangement of FIG. 3*a*. Thus, it is possible to use the rudder arrangement according to FIG. 3*b* for much bigger ships than this is the case for the arrangement of FIG. 3*a*.

Figure 5:
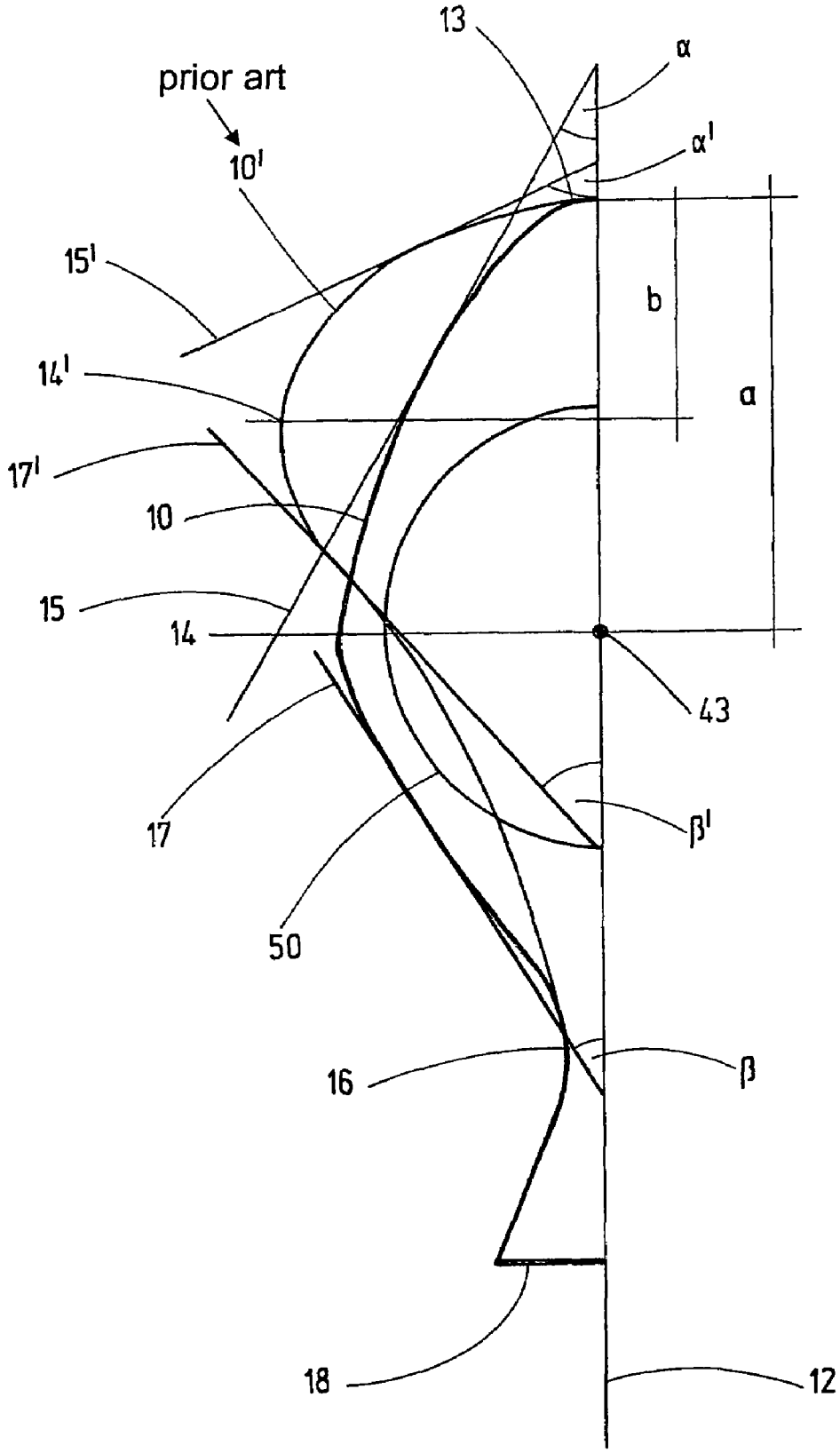
FIG. 5 is a schematic partial view of a cross-sectional profile according to the invention which is superimposed to a profile known from the prior art.

FIG. 5 shows respectively a half of two rudder profiles 10, 10' which are placed above each other. The rudder profile 10 which is characterized with a thicker line corresponds to the profile of a rudder according to the invention while the profile 10' corresponds to a rudder as it is known from the prior art. The rudder profiles 10, 10' are divided longitudinally by an intersection line 12, wherein the intersection line 12 corresponds simultaneously to the longitudinal axis of the rudder profiles. The other halves of the rudder profiles 10, 10' are configured mirror-inverted and are omitted for reasons of clarity. The illustration of FIG. 5 is only a schematic illustration for illustrating the differences between the profile according to the invention 10 and the profile 10' known by the prior art and is not made to correct scale.

The profile 10 according to the invention widens from the rounded off configured leading edge 13 in rudder longitudinal direction with a first flank angle α to a central area 14. From there, the profile tapers again with a flank angle β to the rear area 16. The rear area 16 constitutes the narrowest point of the rudder profile, whereas the central area 14 constitutes the widest point of the rudder profile. From the rear area 16, the profile widens again with the shape of a fishtail to the trailing edge 18. The rudder trunk 50 with the rudder post placed therein is provided in the central area 14 of the rudder profile. The pivotal point 43 of the rudder profile and the rudder post centre respectively is situated in the area of the thickest profile point 14. The distance between the pivotal point or the thickest profile point and the front leading edge 13 is indicated by the letter "a" and corresponds to approximately 40% of the overall length of the rudder.

Contrary to this, the profile 10' known from the prior art widens from the leading edge 13 with a much bigger flank angle α'. Thus, the area of the thickest profile thickness 14' is much closer to the front leading edge 13 than it is the case for the profile 10 according to this very invention. The distance between the central area 14' of the profile 10' and the leading edge 13 is indicated by the letter b and corresponds to approximately 20% of the overall length of the rudder profile 10'. The rudder profile 10' tapers from the central area 14' with a flank angle β' to the rear area 16, wherein the flank angle β' is also bigger than the flank angle β. In the area between the central area 14' and the rear area 16, the profile 10' forms a concave curve, whereas the profile course of the profile 10 is slightly convex between the central area 14 and the rear area 16. Due to the configuration of the rudder profile 10 according to the invention, it is possible to provide a rudder trunk 50 which penetrates deeply into the rudder blade 10. For the profile 10' known from the prior art, this would not be possible since there would not be enough space for the rudder trunk 50 in the area of the pivotal point 43. Furthermore, the profile 10' is wider in its central area 14' than the profile 10 in its central area 14 so that there is a higher drag for the profile 10' than for the profile 10.

While specific embodiments of the invention have been shown and described in detail to illustrate the inventive principles, it will be understood that the invention may be embodied otherwise without departing from such principle.

We claim:

1. A high performance rudder (100) for ships, which is configured as a full spade rudder, comprising a rudder blade (10), a rudder trunk (50) and a rudder post (40), the rudder blade (10) having a leading edge (13) and a trailing edge (18), wherein the profile of the rudder blade (10) widens from a leading edge (13) in a longitudinal direction of the rudder (100) to a central area (14) which is the widest point of the rudder profile, the profile having a first flank angle (α), so that the profile of the rudder blade (10) tapers from the central area (14) to a rear area (16), which constitutes the narrowest point of the rudder profile, and a second flank angle (β), so that the profile of the rudder blade (10) widens again, in the form of a fishtail, from the rear area (16) to the trailing edge (18), and that the rudder trunk (50) is provided as a cantilever girder with a central inner longitudinal bore (52) for receiving the rudder post (40) and extends into the rudder blade (10), whereby a bearing (53) is disposed in the inner longitudinal bore (52) of the rudder trunk (50) for supporting the rudder post (40), the rudder trunk (50) penetrating with its free end (51) into a recess or taper (11) in the rudder blade (10), whereby an end area (41) of the rudder post (40) is guided out of the rudder trunk (50) and is connected with the rudder blade (10), whereby no bearing is provided between the rudder blade (10) and the rudder trunk (50) and whereby the bearing (53) for supporting the rudder post (40) is disposed in the rudder trunk (50) in the area of the free end (51) of the rudder trunk (50).

2. The high performance rudder for ships according to claim 1, wherein the rudder profile is configured symmetrical.

3. The high performance rudder according to claim 1, wherein the trailing edge (18) comprises two superimposed trailing edge sections (18*a*, 18*b*) which are disposed laterally offset to each other.

4. The high performance rudder according to claim 3, wherein the trailing edge sections (18*a*, 18*b*) have in the shape of a half, longitudinally divided fishtail.

5. The high performance rudder according to claim 1, wherein the first flank angle (α) is 5° to 25°.

6. The high performance rudder according to claim 1, wherein the first flank angle (α) is 10° to 20°.

7. The high performance rudder according to claim 1, wherein the first flank angle (α) is 12° to 16°.

8. The high performance rudder according to claim 1, wherein the second flank angle (β) is 5° to 17°.

9. The high performance rudder according to claim 1, wherein the second flank angle (β) is 8° to 13°.

10. The high performance rudder according to claim 1, wherein the second flank angle (β) is 11°.

11. The high performance rudder according to claim 1, wherein a ratio of the width of the trailing edge (18) to the width of the central area (14) is 0.3 to 0.58.

12. The high performance rudder according to claim 1, wherein a ratio of the width of the trailing edge (18) to the width of the central area (14) is 0.35 to 0.58.

13. The high performance rudder according to claim 1, wherein a ratio of the width of the trailing edge (18) to the width of the central area (14) is 0.38 to 0.43.

14. The high performance rudder according to claim 1, wherein a length ratio of the distance from the rudder post middle to the leading edge (13) to the overall length of the rudder (10) is 0.25 to 0.45.

15. The high performance rudder according to claim 1, wherein a length ratio of the distance from the rudder post middle to the leading edge (13) to the overall length of the rudder (10) is 0.35 to 0.43.

16. The high performance rudder according to claim 1, wherein a length ratio of the distance from the rudder post middle to the leading edge (13) to the overall length of the rudder (10) is 0.38 to 0.42.

17. The high performance rudder according to claim 1, wherein the rudder post (40) is disposed in the central area (14).

18. The high performance rudder according to claim 1, wherein the rudder profile between the central area (14) and the rear area (16) has a substantially straight-lined or a substantially convex curved course.

19. A ship comprising a high performance rudder (100) having a rudder blade (10), a rudder trunk (50) and a rudder post (40), the rudder blade (10) having a leading edge (13) and a trailing edge (18), wherein the profile of the rudder blade (10) widens from a leading edge (13) in a longitudinal direction of the rudder (100) to a central area (14) which is the widest point of the rudder profile, the profile having a first flank angle (α), so that the profile of the rudder blade (10) tapers from the central area (14) to a rear area (16), which constitutes the narrowest point of the rudder profile, and a second flank angle (β), so that the profile of the rudder blade (10) widens again, in the form of a fishtail, from the rear area (16) to the trailing edge (18), and that the rudder trunk (50) is a cantilever girder with a central inner longitudinal bore (52) for receiving the rudder post (40) and extends into the rudder blade (10), whereby a bearing (53) is disposed in the inner longitudinal bore (52) of the rudder trunk (50) for supporting the rudder post (40), the rudder trunk (50) penetrating with its free end (51) into a recess or taper (11) in the rudder blade (10), whereby an end area (41) of the rudder post (40) is guided out of the rudder trunk (50) and is connected with the rudder blade (10), whereby no bearing is provided between the rudder blade (10) and the rudder trunk (50) and whereby the bearing (53) for supporting the rudder post (40) is disposed in the rudder trunk (50) in the area of the free end (51) of the rudder trunk (50).

20. The ship according to claim 19, the ship comprising a propeller (30) assigned to the rudder (100) and placed on a drivable propeller spindle, wherein the connection of the rudder post (40) with the rudder blade (10) is situated above the propeller spindle middle (31).

21. The according to claim 19, wherein the ratio of the propeller diameter to the height of the rudder blade (10) ranges from 0.8 to 0.95.

22. The according to claim 19, wherein the ratio of the propeller diameter to the height of the rudder blade (10) ranges from 0.82 to 0.9.

23. The according to claim 19, wherein the ratio of the propeller diameter to the height of the rudder blade (10) ranges from 0.85 to 0.87.

* * * * *